US010161194B2

(12) United States Patent
Clemens et al.

(10) Patent No.: US 10,161,194 B2
(45) Date of Patent: Dec. 25, 2018

(54) CONNECTOR FOR A DOWNHOLE CONVEYANCE

(71) Applicant: Halliburton Energy Services, Inc., Houston, TX (US)

(72) Inventors: Jack Gammill Clemens, Fairview, TX (US); Dominick Joseph Bellotte, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 235 days.

(21) Appl. No.: 15/028,648

(22) PCT Filed: Nov. 11, 2013

(86) PCT No.: PCT/US2013/069499
§ 371 (c)(1),
(2) Date: Apr. 11, 2016

(87) PCT Pub. No.: WO2015/069300
PCT Pub. Date: May 14, 2015

(65) Prior Publication Data

US 2016/0258226 A1 Sep. 8, 2016

(51) Int. Cl.
*E21B 17/02* (2006.01)
*E21B 47/12* (2012.01)

(52) U.S. Cl.
CPC ..... *E21B 17/023* (2013.01); *E21B 47/12* (2013.01)

(58) Field of Classification Search
CPC ..... E21B 17/028; E21B 17/023; E21B 47/12
See application file for complete search history.

(56) References Cited

U.S. PATENT DOCUMENTS 2,085,333 A 6/1937 Reynolds
2,127,115 A 8/1938 Hamilton
2,984,881 A * 5/1961 Greer ..... F16G 11/048 403/16
4,108,245 A 8/1978 Babineaux
4,598,897 A 7/1986 Aikioniemi
(Continued)

FOREIGN PATENT DOCUMENTS

EP 0257856 A2 3/1988
EP 1255339 B1 10/2006
(Continued)

OTHER PUBLICATIONS

PCT International Search Report and Written Opinion of the International Searching Authority, PCT/US2013/069499, dated Aug. 14, 2014, 19 pages.

*Primary Examiner* — Michael R Wills, III
(74) *Attorney, Agent, or Firm* — Scott Richardson; Parker Justiss, P.C.

(57) ABSTRACT

A downhole tool includes a housing that includes a bore therethrough to receive a portion of a downhole conveyance that extends linearly through the bore from a first opening in the housing to a second opening in the housing, the downhole conveyance including a communication line sized to communicate instructions that includes at least one of logic or data; and a grip assembly at least partially positioned in the bore to engagingly hold the portion of the downhole conveyance at a tension at least equal to a breaking strength of the downhole conveyance.

30 Claims, 6 Drawing Sheets

(56) References Cited

U.S. PATENT DOCUMENTS

| | | | | |
|---|---|---|---|---|
| 4,706,744 | A * | 11/1987 | Smith | E21B 17/023 166/65.1 |
| 4,725,783 | A | 2/1988 | Miyairi et al. | |
| RE32,847 | E | 1/1989 | Briscoe et al. | |
| 6,353,979 | B1 | 3/2002 | Traktovenko | |
| 8,375,527 | B1 | 2/2013 | Crow et al. | |
| 8,381,364 | B2 | 2/2013 | Kubo et al. | |
| 2008/0047710 | A1 | 2/2008 | Rose | |
| 2010/0314122 | A1 * | 12/2010 | Sbordone | E21B 33/076 166/345 |
| 2012/0145395 | A1 * | 6/2012 | Streater, Jr. | E21B 31/00 166/301 |
| 2012/0240365 | A1 | 9/2012 | Van der Ende | |
| 2012/0318494 | A1 | 12/2012 | Michaud et al. | |

FOREIGN PATENT DOCUMENTS

| | | | |
|---|---|---|---|
| WO | WO 2001/001015 | A1 | 1/2001 |
| WO | WO 2001/020129 | A2 | 3/2001 |

* cited by examiner

CONNECTOR FOR A DOWNHOLE CONVEYANCE

CROSS-REFERENCE TO RELATED APPLICATIONS

This application is a U.S. National Phase application under 35 U.S.C. § 371 and claims the benefit of priority to International Application Serial No. PCT/US2013/069499, filed on Nov. 11, 2013, the contents of which are hereby incorporated by reference.

TECHNICAL BACKGROUND

This disclosure relates to connectors for downhole conveyances in well systems.

BACKGROUND

A connector (e.g., a socket) is often used to connect a downhole conveyance to a downhole tool string in a well system. For example, a downhole conveyance can be a wire (e.g., wireline, slickline, and/or other downhole cable) for withstanding the dynamic and static weight of the downhole tool string. Some connectors are used for metallic downhole conveyances that are bent (e.g., tightly) to be terminated in the connectors. As the downhole conveyances evolve to communicate telemetric signals with the downhole tool string, the downhole conveyances may include non-metallic or composite materials that may not be tightly bent.

DETAILED DESCRIPTION

Figure 1:
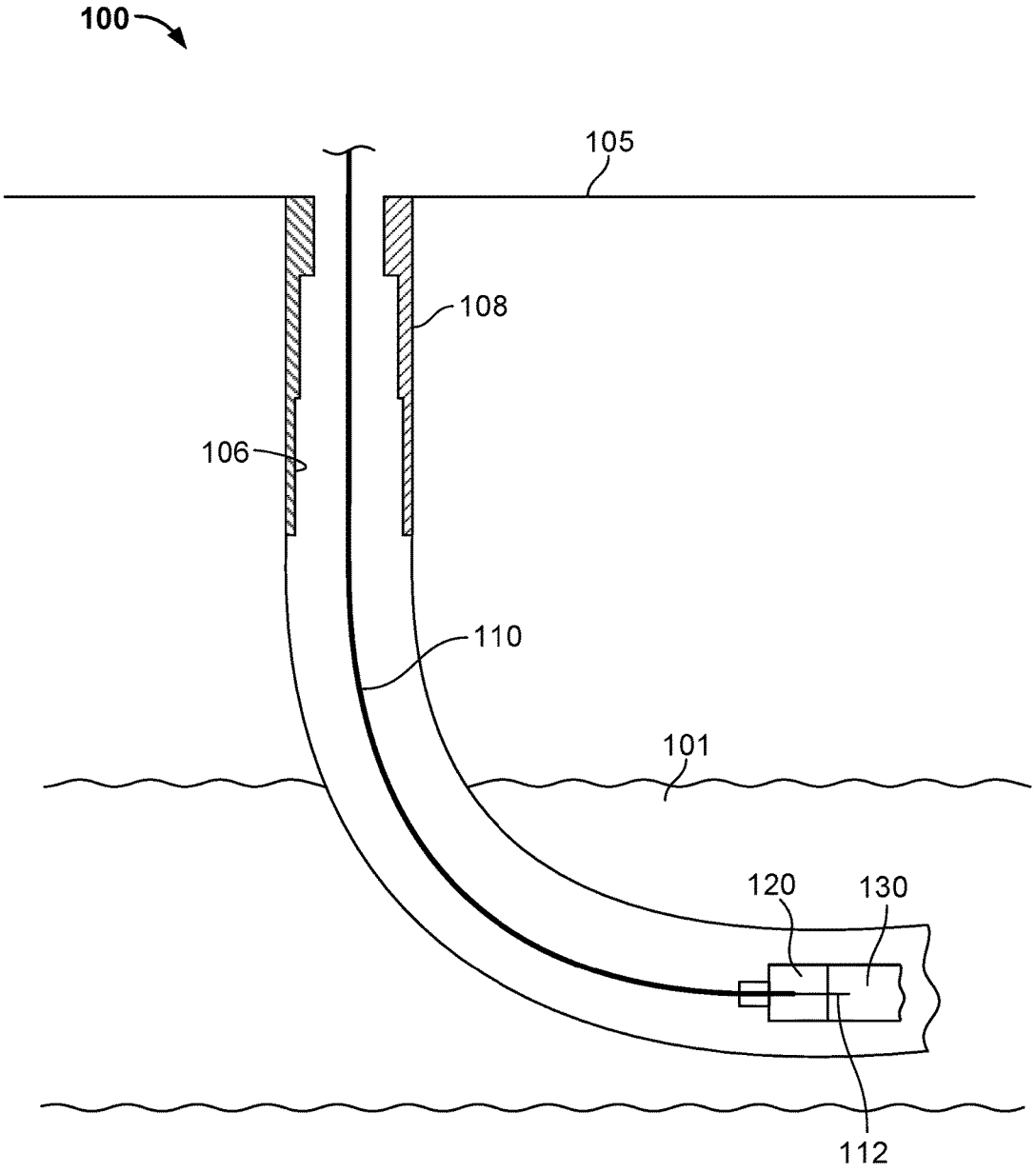
FIG. 1 is a schematic cross-sectional side view of a well system with an example connector for a downhole conveyance.

The present disclosure relates to using a downhole tool (e.g., a connector or socket) for a downhole conveyance, such as a slickline, electric line ("e-line"), or wireline, that includes a wire coupled with a communication line, such as a fiber optic cable or metallic (or non-metallic) conductor. In one general implementation, a downhole tool includes a housing that includes a bore therethrough to receive a portion of a downhole conveyance that extends linearly through the bore from a first opening in the housing to a second opening in the housing, the downhole conveyance including a communication line sized to communicate instructions that includes at least one of logic or data; and a grip assembly at least partially positioned in the bore to engagingly hold the portion of the downhole conveyance at a tension at least equal to a breaking strength of the downhole conveyance.

In a first aspect combinable with the general implementation, the communication line includes at least one of a fiber optic line or a metallic conductor.

In a second aspect combinable with any of the previous aspects, the downhole conveyance includes a non-metallic composite material.

In a third aspect combinable with any of the previous aspects, the grip assembly includes a sleeve that encloses the portion of the downhole conveyance; and a tubular member positioned in the housing to receive and engagingly hold the portion of the downhole conveyance enclosed by the sleeve, an interface between the sleeve and the tubular member including an increased friction surface relative to an interface between the downhole conveyance and the tubular member.

In a fourth aspect combinable with any of the previous aspects, the sleeve includes a stainless steel mesh.

In a fifth aspect combinable with any of the previous aspects, the housing includes a first half shell and a second half shell, the first and second half shells enclosing the tubular member and coupled together with one or more fasteners to bias the tubular member radially against the sleeve.

In a sixth aspect combinable with any of the previous aspects, the grip assembly includes a wedge enclosed in a portion of the bore, the wedge including an outer radial surface interfaced with a tapered portion of the bore and an inner radial surface that engagingly holds the portion of the downhole conveyance at the tension.

In a seventh aspect combinable with any of the previous aspects, the grip assembly further includes a threaded connection between the outer radial surface of the wedge and the tapered portion of the bore.

In an eighth aspect combinable with any of the previous aspects, the grip assembly further includes a biasing member, positioned in the bore adjacent the wedge, that exerts a biasing force to drive the wedge toward a smaller opening of the tapered portion of the bore.

In a ninth aspect combinable with any of the previous aspects, the biasing member includes at least one spring.

In a tenth aspect combinable with any of the previous aspects, the housing further includes at least one port fluidly coupled to an annulus of a wellbore when the downhole tool is in a run-in position in the wellbore such that at least a portion of the bore is at a hydrostatic pressure of the annulus, the biasing member including a piston, in contact with the wedge, that drives the wedge toward the smaller opening based on the hydrostatic pressure.

An eleventh aspect combinable with any of the previous aspects further includes a bottom hole connection assembly coupled with the housing and including a bore therethrough that receives the downhole conveyance and is coupled to the bore of the housing.

In another general implementation, a method includes running a downhole tool coupled to a downhole conveyance into a wellbore from a terranean surface. The downhole tool includes a housing that includes a bore therethrough, the downhole conveyance extending linearly through the bore from a first opening in the housing to a second opening in the housing, the downhole conveyance including a communication line sized to communicate instructions that include at least one of logic or data; and a grip assembly at least partially positioned in the bore to receive and engagingly hold the downhole conveyance in the downhole tool at a tension. The method includes exerting a force on the downhole conveyance in an uphole direction; and resisting the force on the downhole conveyance with the grip assembly.

In a first aspect combinable with the general implementation, the communication line includes at least one of a fiber optic line or a metallic conductor.

In a second aspect combinable with any of the previous aspects, the downhole conveyance includes a non-metallic composite material.

In a third aspect combinable with any of the previous aspects, resisting the force on the downhole conveyance with the grip assembly includes engaging a sleeve that encloses the portion of the downhole conveyance with a tubular member positioned in the housing, an interface between the sleeve and the tubular member including an increased friction surface relative to an interface between the downhole conveyance and the tubular member; and holding the downhole conveyance, based on the interface of the sleeve and the tubular member, to withstand the force exerted on the wire.

In a fourth aspect combinable with any of the previous aspects, the sleeve includes a stainless steel mesh.

In a fifth aspect combinable with any of the previous aspects, the housing includes a first half shell and a second half shell, the first and second half shells enclosing the tubular member and coupled together with one or more fasteners, the method including biasing the tubular member radially against the sleeve by the one or more fasteners.

In a sixth aspect combinable with any of the previous aspects, resisting the force on the wire with the grip assembly includes holding the downhole conveyance with a wedge enclosed in a portion of the bore, the wedge including an outer radial surface interfaced with a tapered portion of the bore and an inner radial surface at the tension.

In a seventh aspect combinable with any of the previous aspects, the wedge is threadingly coupled at the outer radial surface with the tapered portion of the bore.

An eighth aspect combinable with any of the previous aspects further includes biasing the wedge with a biasing member positioned in the bore adjacent the wedge; and driving the wedge toward a smaller opening of the tapered portion of the bore to hold the downhole conveyance with the wedge.

In a ninth aspect combinable with any of the previous aspects, the biasing member includes at least one spring.

A tenth aspect combinable with any of the previous aspects further includes hydraulically driving the wedge toward a smaller opening of the tapered portion of the bore to hold the downhole conveyance with the wedge.

In an eleventh aspect combinable with any of the previous aspects, hydraulically driving the wedge toward a smaller opening of the tapered portion of the bore includes exposing an interior cavity of the housing to a hydrostatic pressure in the wellbore; and driving a piston mounted in the interior cavity against the wedge based on a difference in the hydrostatic pressure and a pressure in the bore of the housing.

In another general implementation, a downhole system includes a wireline conveyance extendable from a terranean surface to a position in a wellbore adjacent a subterranean zone, the wireline conveyance sized to communicate instructions that include at least one of logic or data; a connector coupled to a portion of the wireline conveyance. The connector includes a gripping member that defines a passage for receiving the portion of the wireline conveyance, the portion of the wireline conveyance extending linearly through the passage, the gripping member engagingly holding the portion of the wireline conveyance at a tension at least equal to a breaking strength of the wireline conveyance; and a housing member that includes a bore that encloses the gripping member. The system further includes a downhole tool string coupled to the wireline conveyance through the connector to receive or communicate the instructions between the downhole tool string and the terranean surface.

In a first aspect combinable with the general implementation, the gripping member includes a sleeve that encloses the portion of the wireline conveyance; and a tubular member that receives and engagingly holds the portion of the wireline conveyance enclosed by the sleeve, an interface between the sleeve and the tubular member including an increased friction surface relative to an interface between the wireline conveyance and the tubular member.

In a second aspect combinable with any of the previous aspects, the housing member includes a body and a cover, the body and the cover enclosing the tubular member and coupled together with one or more fasteners to bias the tubular member radially against the sleeve, the body including one or more resisting members to keep the gripping member and the cover axially in position.

In a third aspect combinable with any of the previous aspects, the gripping member includes a wedge enclosed in a portion of the bore, the wedge including an outer radial surface interfaced with a tapered portion of the bore and an inner radial surface that engagingly holds the portion of the wireline conveyance at the tension; and a biasing member, positioned in the bore adjacent the wedge, that exerts a biasing force to drive the wedge toward a smaller opening of the tapered portion of the bore.

In a fourth aspect combinable with any of the previous aspects, the biasing member includes at least one spring.

In a fifth aspect combinable with any of the previous aspects, the housing member further includes at least one port fluidly coupled to an annulus of the wellbore when the connector is in a run-in position in the wellbore such that at least a portion of the bore is at a hydrostatic pressure of the annulus, the biasing member including a piston, in contact with the wedge, that drives the wedge toward the smaller opening based on the hydrostatic pressure Various implementations of a downhole tool (e.g., a connector, a socket, or a rope socket) in accordance with the present disclosure may include one, some, or all of the following features. For example, the downhole tool enables a downhole conveyance (e.g., a slickline, a wireline, or a downhole cable) to be terminated in the downhole tool without substantial bending (e.g., linearly terminated), such that the downhole conveyance can include a non-metallic or composite material that is easy to break upon substantial bending. In such cases, a communication line (e.g., optical fiber, metallic conductor, or non-metallic conductor) can be included in the downhole conveyance to communicate instructions (e.g., logic and/or data) between a downhole tool string and a terranean surface. In some aspects, the downhole tool enables an engaging and secure grip on the downhole conveyance at a tension at least up to a breaking strength of the downhole conveyance. The downhole tool includes a sleeve to substantially increase a friction surface between the downhole conveyance and the downhole tool, such that a force on the downhole conveyance is distributed (e.g., evenly) over the increased friction surface and the localized strain on the downhole conveyance is substantially reduced, e.g., down to below the breaking strength. In some aspects, the downhole tool is self-energized (e.g., via hydraulic pressure, threading, biasing, clamping, or any proper combinations thereof) without external actions to keep the downhole conveyance retained without breakage and/or with little to no slippage.

FIG. 1 is a schematic cross-sectional side view of a well system 100 with an example connector 120 (e.g., a rope socket) for a downhole conveyance 110 (e.g., a downhole carrier or a downhole cable). The well system 100 is provided for convenience of reference only, and it should be appreciated that the concepts herein are applicable to a number of different configurations of well systems. The well system 100 includes a wellbore 108 that extends from a terranean surface 105 through one or more subterranean zones of interest 101. In FIG. 1, the wellbore 108 initially extends vertically and transitions horizontally. In other instances, the wellbore 108 can be of another position, for example, deviates to horizontal in the subterranean zone 101, entirely substantially vertical or slanted, it can deviate in another manner than horizontal, it can be a multi-lateral, and/or it can be of another position.

At least a portion of the illustrated wellbore 108 may be lined with a casing 106, constructed of one or more lengths of tubing, that extends from the terranean surface 105, downhole, toward the bottom of the wellbore 108. The casing 106 provides radial support to the wellbore 108 and seals against unwanted communication of fluids between the wellbore 108 and surrounding formations. Here, the casing 106 ceases at or near the subterranean zone 101 and the remainder of the wellbore 108 is an open hole, e.g., uncased. In other instances, the casing 106 can extend to the bottom of the wellbore 108 or can be provided in another position and in multiple circumferences or thicknesses (e.g., conductor casing, surface casing, intermediate casing, production casing, or otherwise).

As illustrated, a downhole tool string 130 (e.g., one or more downhole tools) is coupled to (e.g., supported by) the downhole conveyance 110 through the connector 120. The downhole conveyance 110 can be, for example, a wireline, a slickline, or an electric line. In the illustrated embodiment, the downhole conveyance 110 includes a wire (e.g., a single wire such as slickline, or a solid wire) and a communication line 112. The communication line 112 is coupled with the wire such as, for example, embedded in, intertwined with one or more wires, or wrapped around or within one or more wires, in a non-linear (e.g., undulating, helical, zig-zag, or otherwise) configuration.

In some implementations, the downhole conveyance 110 supports the downhole tool string 130 and can communicate instructions, data, and/or logic between the downhole tool string 130 and the terranean surface 105 through the communication line 112 (e.g., optical fiber, metallic conductor, or non-metallic conductor). In some examples, the downhole tool string 130 may communicate with computing systems or other equipment at the surface 105 using the communication capabilities of the downhole conveyance 110. For example, the downhole tool string 130 may send and receive electrical signals and/or optical signals (e.g., data and/or logic) through respective conductor wire and/or fiber optics of the communication line within the downhole conveyance 110. In addition, the downhole tool string 130 may be lowered or raised relative to the wellbore 108 by respectively extending or retrieving the downhole conveyance 110.

In some implementations, the downhole conveyance 110 can be formed from a metallic or non-metallic material, such as a composite material (e.g., polyphenylene sulfide or other organic polymer, high-performance thermoplastic, or otherwise). In some examples, the downhole conveyance 110 may not be bent largely (and/or tightly) into a shape (e.g., a circular shape) to be terminated in the connector 120. With large bending, a portion of the downhole conveyance 110, e.g., the communication line or the non-metallic material, may be broken and/or damaged.

In the illustrated embodiment, the downhole conveyance 110 extends linearly in the connector 120, without requiring substantial bending of the downhole conveyance 110. The wire of the downhole conveyance 110 is linearly terminated within the connector 120, and the communication line 112 may extend through the connector 120 to be coupled to the downhole tool string 130. In such cases, strain on the downhole conveyance 110 may remain symmetrical in response to tension on the downhole conveyance 110, and there is little or no transverse force to break the downhole conveyance 110.

In some implementations, the connector 120 engagingly holds the downhole conveyance 110 at a tension to resist a force on the downhole conveyance 110, e.g., a dynamic and static weight of the downhole tool string 130. The weight can include dynamic and static tension loads in the downhole conveyance 110 when the downhole tool string 130 accelerates or decelerates, as well as torsional loads and/or temperature variations. The connector 120 is coupled to the downhole tool string 330 and moves together with the downhole tool string 330, and the force on the downhole conveyance 110 can also include the dynamic and static weight of the connector 120.

In some cases, the force on the downhole conveyance 110 may be larger than a breaking strength (e.g., a maximum allowable strain) of the downhole conveyance 110. The connector 120 can engagingly hold the downhole conveyance 110 to resist the force such that localized strain on the downhole conveyance 110 is reduced to be smaller than the maximum allowable strain of the downhole conveyance. Thus the downhole conveyance 110 can avoid failure. In other words, the connector 120 can engagingly hold the portion of the downhole conveyance 110 at a tension at least equal to a breaking strength of the downhole conveyance, while the downhole conveyance remains unbroken and securely retained in the connector 120.

FIGS. 2A-2B, 3A-3B, and 4A-4D illustrate example embodiments of connectors for holding downhole conveyances. In some aspects, the illustrated connectors may be self-energized without external actions to keep the downhole conveyances retained without breakage and/or with little to no slippage.

Figure 2A:
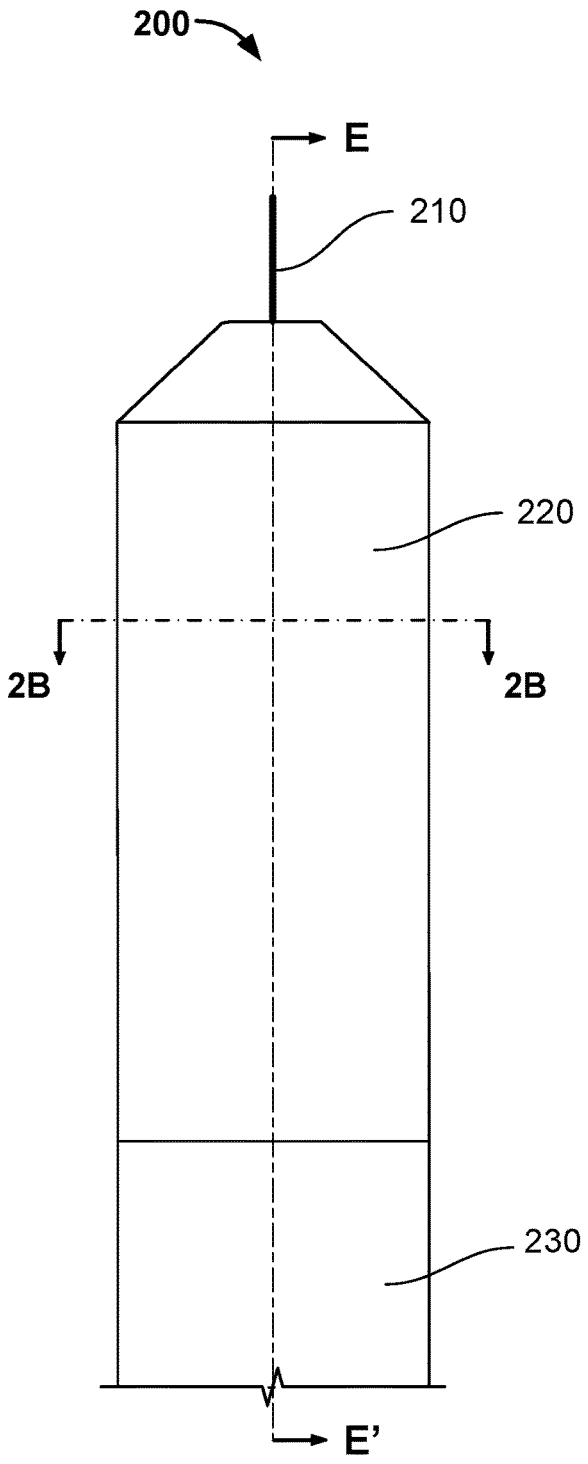
FIGS. 2A-2B illustrate an example embodiment of a connector for connecting a downhole conveyance to a downhole tool string.
Figure 2B:
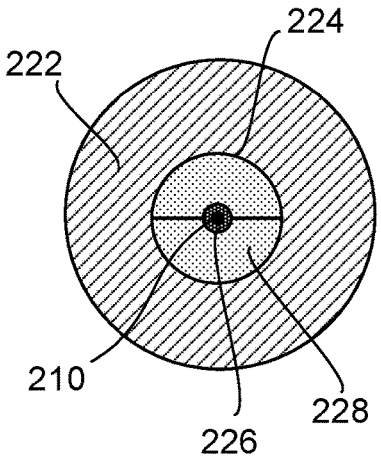

FIGS. 2A-2B illustrate an example system 200 of a connector 220 for connecting a downhole conveyance 210 to a downhole tool string 230. In some aspects, the downhole conveyance 210, the connector 220, and the downhole tool string 230 can be used as or in place of the downhole conveyance 110, the connector 120 and the downhole tool string 130 described in FIG. 1, respectively. FIG. 2A is a side view of the example system 200. FIG. 2B is a cross sectional top view of the connector 220 engagingly holding the downhole conveyance 210.

In some implementations, the downhole conveyance 210 extends from a terranean surface (e.g., the terranean surface 105 of FIG. 1) to a position in a wellbore (e.g., the wellbore 108 of FIG. 1) adjacent a subterranean zone (e.g., the subterranean zone 101 of FIG. 1). The downhole conveyance 210 can include a wire that is configured to support the downhole tool string 230 through the connector 220. The downhole conveyance 210 further includes a communication line (e.g., the communication line 112 of FIG. 1) that is coupled with the wire. The communication line can be sized to communicate instructions that include logic and/or data to the downhole tool string 230. The communication line extends through the connector 220 and is coupled to the downhole tool string 230. The downhole tool string 230 is coupled to the downhole conveyance 210 through the connector 220 and communicates the instructions between the downhole tool string 230 and the terranean surface through the communication line.

In some implementations, the connector 220 includes a housing 222 and a grip assembly 224. The housing 222 can include a bore therethrough to receive a portion of the downhole conveyance 210. The downhole conveyance 210 can extend linearly through the bore from a first opening in the housing to a second opening in the housing 222. The grip assembly 224 may be at least partially positioned in the bore to engagingly hold the portion of the downhole conveyance 210 at a tension to resist a force on the downhole conveyance 210. The tension varies with the force, e.g., a dynamic and static weight of the downhole tool string (or in combination of a dynamic and static weight of the connector 220). In some examples, the tension is at least up to a breaking strength of the downhole conveyance 210.

In one example of the grip assembly 224, as shown in FIG. 2B, the grip assembly 224 includes a sleeve 226 and a tubular member 228. The sleeve 226 lies between the downhole conveyance 210 and the tubular member 228, and encloses the portion of the downhole conveyance 210 in any desired shape (e.g., helical or non-helical). The tubular member 228 is positioned in the bore of the housing 222 to receive and engagingly hold the portion of the downhole conveyance 210 enclosed by the sleeve 226. The sleeve 226 can substantially increase a friction surface between the downhole conveyance 210 and the tubular member 228. In some examples, the sleeve 226 is a stainless steel mesh.

With the increased friction surface, the grip assembly 224 can securely hold the portion of the downhole conveyance 210 in the connector 220. With the increased friction surface, the strain on the downhole conveyance 210 can be also distributed (e.g., evenly) over the increased friction surface, such that the localized strain on the downhole conveyance 210 can be substantially reduced, e.g., down to below a breaking strength of the downhole conveyance, when the force is at least up to the breaking strength.

In some implementations, the tubular member 228 includes two mating parts. The two mating parts define a passage for receiving the portion of the downhole conveyance 210 enclosed by the sleeve 226. The passage can have any desired shape (e.g., circular, rectangular, or elliptical) to fit with an outer shape of the downhole conveyance 210. The two mating parts can be two identical parts or a larger part matched with a smaller part. The housing 222 encloses the two mating parts and exerts a force on the two mating parts, such that the tubular member 228 can engagingly and securely hold the portion of the downhole conveyance 210 enclosed by the sleeve 226 to resist the force on the downhole conveyance 210.

Figure 3A:
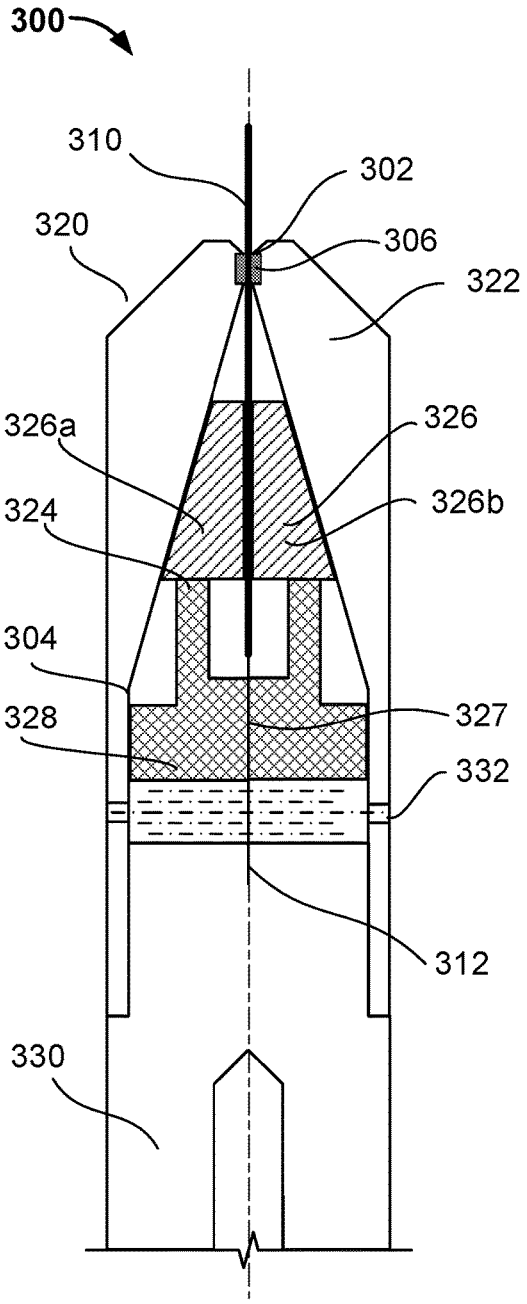
FIG. 3A illustrates a cross-section view of an example embodiment of a connector holding a downhole conveyance with a piston.

FIG. 3A illustrates a cross-section view of an example system 300 of a connector 320 holding a downhole conveyance 310 coupled to a downhole tool string 330 with a piston. The cross-section view can be an E-E' section view of the example system 200 in FIG. 2A. In some aspects, the downhole conveyance 310, the connector 320 and the downhole tool string 330 can be used as or in place of the downhole conveyance 210, the connector 220 and the downhole tool string 230 described in FIGS. 2A-2B, respectively.

In one example of the connector 320, as illustrated in FIG. 3A, the connector 320 includes a housing 322 and a grip assembly 324. In some aspects, the housing 322 and the grip assembly 324 can be used as or in place of the housing 222 and the grip assembly 224 described in FIGS. 2A-2B, respectively. The housing 322 includes a bore therethrough to receive a portion of the downhole conveyance 310 that extends linearly through the bore from a first opening 302 in the housing 322 to a second opening 304 in the housing 322.

Similar to the downhole conveyance 210, the downhole conveyance 310 can include a wire coupled with a communication line 312 (e.g., the communication line 112 of FIG. 1). The wire is linearly terminated within the connector 320, and the communication line 312 passes through the connector 320 and is coupled to the downhole tool string 330. The communication line 312 is sized to communicate instructions with the downhole tool string 330.

In some implementations, the connector 320 includes a bottom hole connection assembly 306 coupled with the housing 322. The bottom hole connection assembly 306 acts as a strain relief element at an entrance of the housing 322 (e.g., at the first opening 302), and includes a bore therethrough that receives the portion of the downhole conveyance 310 and is coupled to the bore of the housing 322.

The bore of the housing 322 may be a tapered tube. A dimension of the bore decreases (e.g., gradually) from the second opening 304 to the first opening 302 of the housing 322. For example, the diameter of the bore at the first opening 302 is smaller (e.g., substantially) than the diameter of the bore at the second opening 304.

As illustrated in FIG. 3A, the grip assembly 324 can include a wedge 326 enclosed in a portion of the bore. The wedge 326 includes an outer radial surface interfaced with the tapered portion of the bore and an inner radial surface that engaging holds the portion of the downhole conveyance 310 at a tension.

In some implementations, the grip assembly 324 includes a threaded connection between the outer radial surface of the wedge 326 and the tapered portion of the bore in the housing 322. For example, the outer radial surface of the wedge 326 can include threads (e.g., male or female) that are matched with corresponding threads (e.g., female or male) on an inner surface of the housing 322 (e.g., at least at the tapered portion of the bore). The wedge 326 can be rotated toward a smaller opening of the tapered portion of the bore and coupled with the inner surface of the housing 322, such that the wedge 326 can securely hold the portion of the downhole conveyance 310.

In some implementations, the wedge 326 includes two mating parts. The two mating parts can be two identical cone halves **326*a* and 326*b*. When the two mating parts are coupled together, they define a passage and the inner radial surface of the wedge 326. The portion of the downhole conveyance 310 passes through the passage and interfaces with the inner radial surface of the wedge 326. A perimeter of the passage may be substantially equal to a circumference of the downhole conveyance 310**.

When the two mating parts are driven toward a smaller opening of the tapered portion of the bore (e.g., the first opening 302), the two mating parts are pressed radially against the housing 322 and forced together. The passage may be deformed, e.g., the perimeter of the passage may be decreased, to engagingly and securely hold the portion of the downhole conveyance 310 in the connector 320. The housing 322 may be formed of any appropriate materials, e.g., metallic or composite construction. The elastic modulus and other material properties of the wedge 326 may be selected to match the material properties of the downhole conveyance 310.

In operation, due to a force on the downhole conveyance 310 in a downhole direction, e.g., a dynamic and static weight of the downhole tool string 330 (or in combination with a dynamic and static weight of the connector 320), the downhole conveyance 310 may be pulled up in an uphole direction. The two mating parts of the wedge 326 interface with the downhole conveyance 310 and are driven toward the smaller opening of the bore (e.g., the first opening 302), such that the downhole conveyance 310 is engagingly and securely held by the two mating parts.

As discussed above, the grip assembly 322 may include a sleeve (e.g., the sleeve 226 of FIG. 2B) that can increase (e.g., substantially) a friction surface between the wedge 326 and the portion of the downhole conveyance 310. The sleeve also can distribute the force on the downhole conveyance 310 over the increased friction surface, such that the localized strain on the downhole conveyance 310 can be substantially reduced. In some examples, the grip assembly 322 engagingly holds the downhole conveyance 310 at a tension at least up to a breaking strength (or a breaking force) of the downhole conveyance 310, while the downhole conveyance 310 remains unbroken and securely retained in the connector 320.

To securely hold the downhole conveyance 310 in the connector 320, additional driving force can be added on the wedge 326 toward the smaller opening of the bore in the housing 322. For example, the grip assembly 324 can include a biasing member positioned in the bore adjacent the wedge 326. The biasing member exerts a biasing force to drive the wedge 326 toward the smaller opening or the first opening 302.

In one example of the biasing member, as illustrated in FIG. 3A, the biasing member includes a piston 328 under a hydrostatic pressure. When the connector 320 is in a run-in position in a wellbore (e.g., the wellbore 108 of FIG. 1), the housing 322 of the connector 320 may include at least one port 332 fluidly coupled to an annulus of the wellbore, e.g., a space between a casing (e.g., the casing 106 of FIG. 1) of the wellbore and the connector 320, such that the port 332 is at a hydrostatic pressure of the annulus. The port 332 may be between the piston 328 and the downhole tool string 330. The grip assembly 322 can include the piston 328 in contact with the wedge 326 that drives the wedge 326 toward the smaller opening of the bore based on a difference in the hydrostatic pressure and a pressure in the bore of the housing 322.

In some implementations, the housing 322 is configured to allow the piston move a certain distance relative to the housing 322 to press the wedge 326 against the inner tapered portion of the bore in the housing 322. In some examples, the piston 328 includes a bore therethrough 327 that allows the communication line 312 pass through to be coupled to the downhole tool string 330.

Figure 3B:
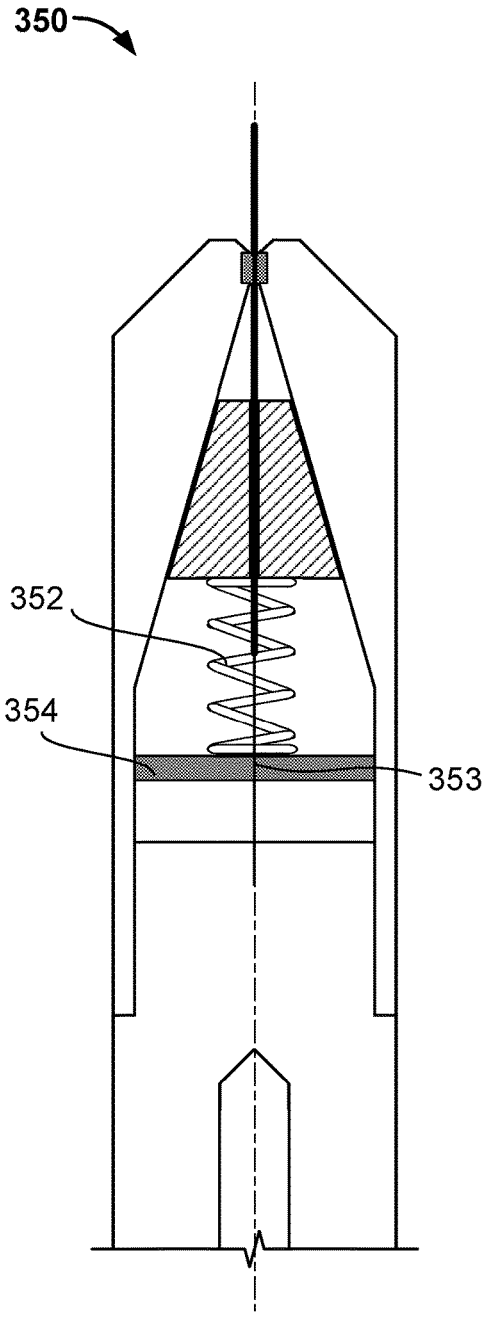
FIG. 3B illustrates a cross-section view of an example embodiment of a connector holding a downhole conveyance with a spring.

FIG. 3B illustrates a cross-section view of an example system 350 of a connector holding a downhole conveyance with a spring 352 (e.g., coiled spring, Belleville washers, or otherwise). The example system 350 is similar to the example system 300 of FIG. 3A, except that the biasing member includes at least one spring 352. The spring 352 is positioned between the wedge 328 and a resisting board 354. The resisting board 354 is in contact with an inner surface of the housing 322 and adjustable along the inner surface.

In operation, the resisting board 354 is adjusted to a certain position and stabilized in the position with screws or a threaded connection between the resisting board and the inner surface of the housing. The spring 352 is compressed and exerts a substantially constant force on the wedge 326 to drive the wedge 326 toward a smaller opening of the bore in the housing 322. In some examples, the resisting board 354 includes a bore therethrough 353 to allow the communication line 312 pass through to be coupled to the downhole tool string 330.

In alternative implementations, the biasing member includes a piston and a spring coupled in series. The piston can be positioned adjacent the wedge, and the spring can be compressed and positioned between the piston and a resisting board. The wedge is driven by at least the substantially constant force exerted by the spring on the piston (or in combination with a hydrostatic pressure on the piston).

FIGS. 4A-4D illustrate a schematic of an example system 400 of a connector 420 holding a downhole conveyance 410 coupled to a downhole tool string (not shown). In some aspects, the downhole conveyance 410 can be used as or in place of the downhole conveyance 210 described in FIGS. 2A-2B.

Figure 4A:
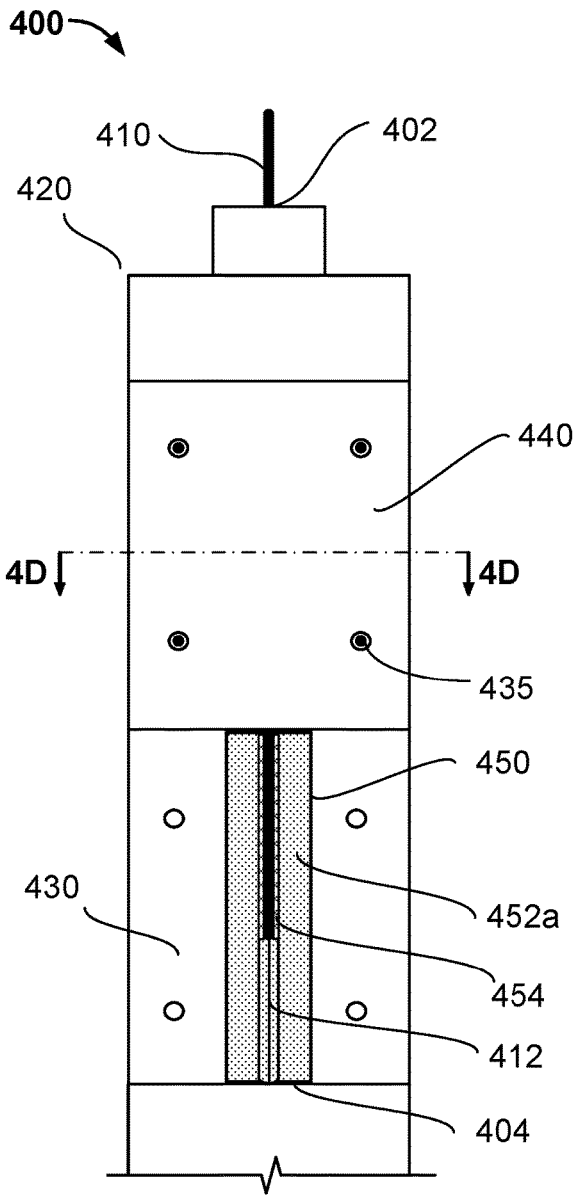
FIGS. 4A-4D illustrate a schematic of an example embodiment of a connector holding a downhole conveyance.
Figure 4B:
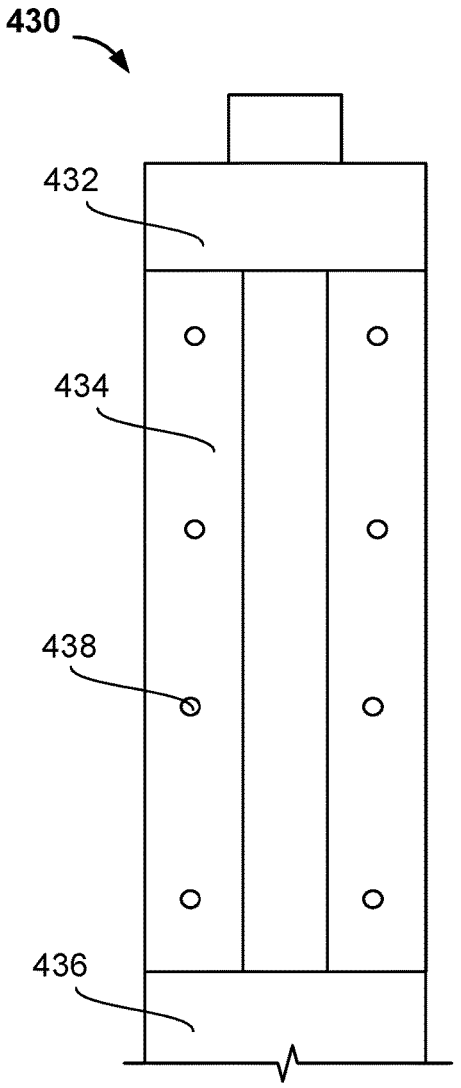
Figure 4C:
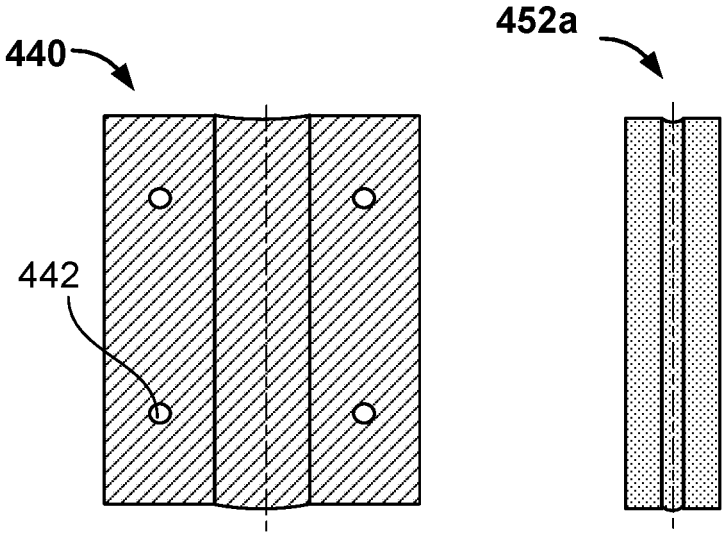

In some implementations, the connector 420 includes a housing and a grip assembly 450. The housing includes a body 430 (as illustrated in FIG. 4B) and a cover 440 (as illustrated in FIG. 4C). The body 430 can be an integrated one including a front resisting member 432, a middle member 434 and a back resisting member 436 coupled in series. The front resisting member 432 and the back resisting member 436 are used to keep the cover 440 and the grip assembly 450 in position. The front resisting members 432 and 436 each can include a bore therethrough for the downhole conveyance 410 to pass through.

In some implementations, the middle member 434 includes a half shell matched with the cover 440 to define a bore therethrough to receive a portion of the downhole conveyance 410, together with the bores of the front and back resisting members. As illustrated in FIG. 4A, the downhole conveyance 410 extends linearly through the bore from a first opening 402 to a second opening 404. The downhole conveyance 410 may include a wire coupled with a communication line 412 (e.g., the communication line 112 of FIG. 1). The wire is linearly terminated within the bore. The communication line 412 passes through the bore and is coupled to the downhole tool string. The communication line 412 is sized to communicate instructions with the downhole tool string.

In some implementations, the middle member 434 and the cover 440 are coupled together with one or more fasteners 435 (e.g., screws or bolts and nuts). The middle member 434 may include one or more bores (or threaded bores) 438 matched with the one or more fasteners 435. The cover 440 may include one or more bores (or threaded bores) 442 that correspond to the one or more bores 438 and match with the one or more fasteners 435.

In some implementations, the grip assembly 450 includes a tubular member 452 and a sleeve 454. In some aspects, the sleeve 454 can be used as or in place of the sleeve 226 described in FIG. 2B. The sleeve 454 increases a friction surface between the tubular member 452 and the portion of the downhole conveyance 410.

In some examples, the tubular member 452 includes a first half shell 452*a* and a second half shell 452*b*. The first and second half shells 452*a* and 452*b* are coupled together to define a passage to receive the portion of the downhole conveyance 410 and engagingly hold the downhole conveyance 410 enclosed by the sleeve 454.

Figure 4D:
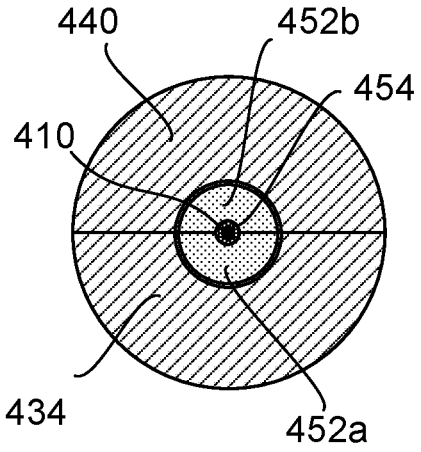

FIG. 4D is a cross sectional top view of the connector 420 engagingly holding the downhole conveyance 410. As illustrated, the downhole conveyance 410 is enclosed by the sleeve 454. The sleeve 454 is within the passage defined by the tubular member 452 and interacts with an inner radial surface of the tubular member 452 (i.e., the first half shell 452*a* and the second half shell 452*b*). The first half shell 452*a* and the second half shell 452*b* are enclosed by the middle member 434 of the body 430 and the cover 440 that are coupled together by the one or more fasteners 435.

In operation, due to a force on the downhole conveyance 410 in a downhole direction, e.g., a dynamic and static weight of the downhole tool string (or in combination with a dynamic and static weight of the connector 420), the downhole conveyance 410 may be pulled up in an uphole direction. The first and second half shelves 452*a* and 452*b* of the tubular member 452 interact with the downhole conveyance 410, and are driven toward the front resisting member 432 along an axial direction. The cover 440 interacts with an outer radial surface of the tubular member 452 (e.g., the second half shelf 452*b*), and is also driven toward the front resisting member 432 along the axial direction. As discussed above, the front resisting member 432 and the back resisting member 436 are fixed to stop the movement of the cover 440 and the tubular member 452 along the axial direction, such that the cover 440 and the tubular member 452 remain in position.

Along a radial direction of the downhole conveyance 410, the body 430 and the cover 440 are coupled together with the one or more fasteners 435 to bias the tubular member 452 radially against the sleeve 454. Due to the biased force, the passage may be deformed, e.g., a diameter of the passage is decreased, such that the tubular member 452 can securely and engagingly hold the downhole conveyance 410 at a tension. The tension varies with the force on the downhole conveyance 410.

In some examples, the tension can be at least up to a breaking strength (or a breaking force) of the downhole conveyance 410. Due to an increased friction surface by the sleeve 454, the force on the downhole conveyance 410 can be distributed over the friction surface, such that the localized strain on the downhole conveyance 410 can be substantially reduced, e.g., down to below the breaking strength of the downhole conveyance 410. Thus the downhole conveyance 410 can remain unbroken and securely retained in the connector 420, even when the force is at least up to the breaking strength of the downhole conveyance 410.

In some implementations, to securely hold the downhole conveyance 410 in the connector 420, the passaged defined by the tubular member 452 of the grip assembly 450 is substantially equal to or slight smaller than a diameter of the downhole conveyance 410 enclosed by the sleeve 454. The bore defined by the middle member 434 of the body 430 and the cover 440 may be substantially equal to or slight smaller than a diameter of the tubular member 452 of the grip assembly 450. The sleeve 454 may include one or more layers of stainless steel meshes, such that the friction surface is optimized to a maximum and that the downhole conveyance 410 is securely held by the tubular member 452.

In some implementations, the grip assembly 450 includes one or more tubular members 452 coupled in series along an axial direction. Correspondingly, the cover includes one more covers 440 matched with the one or more tubular members 452. The total length of the coupled tubular members 452, or the total length of the coupled covers 440, is substantially equal to a length of the middle member 434 of the body 430.

Figure 5:
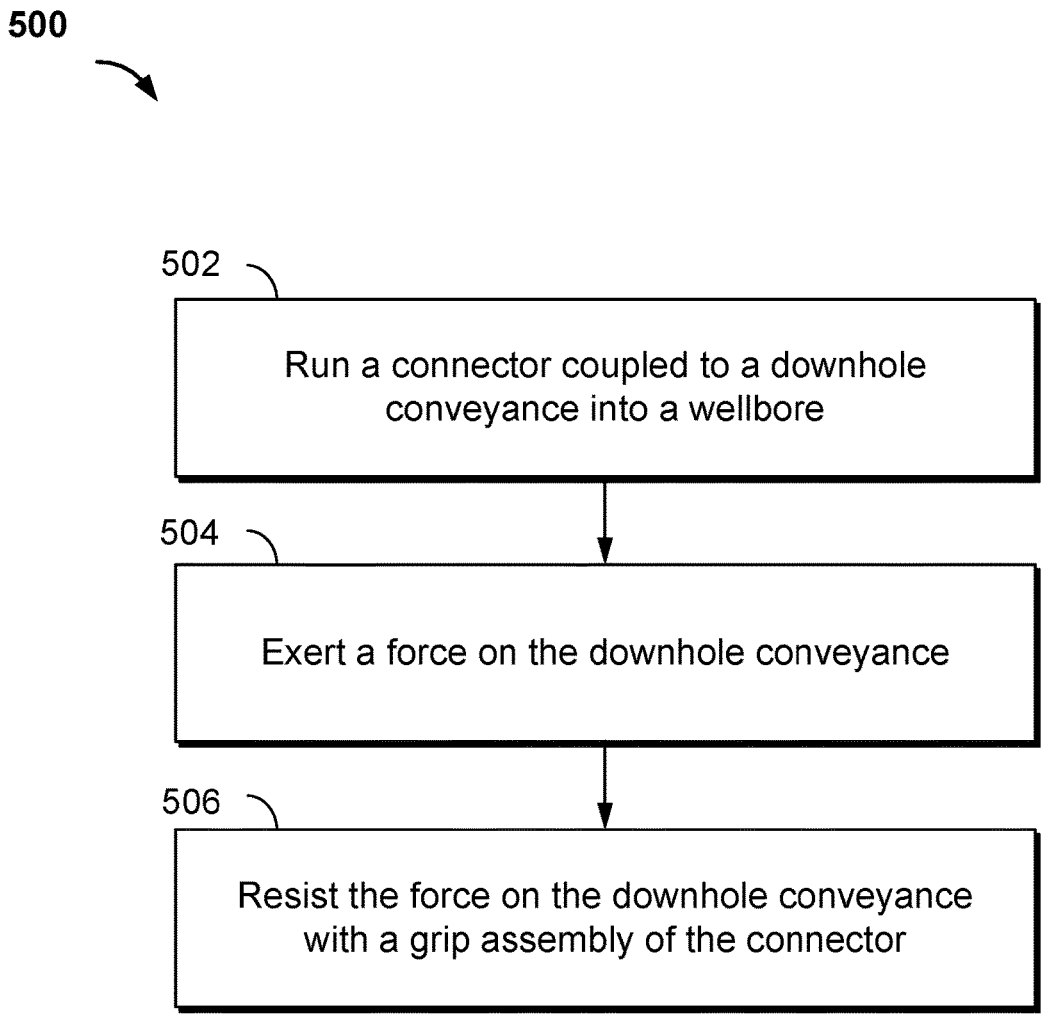
FIG. 5 illustrates an example method performed with a connector.

FIG. 5 illustrates an example method 500 performed with a connector. At 502, a connector coupled to a downhole conveyance is run into a wellbore from a terranean surface. The connector connects the downhole conveyance to a downhole tool string. The downhole conveyance includes a slickline that includes a wire, and a communication line coupled with the wire. The downhole conveyance includes a non-metallic or composite material. The communication line can be used to communicate control or data information between the downhole tool string and computing systems at the terranean surface. For example, the communication line can include at least one of a fiber optic line, or a metallic conductor.

In some implementations, the connector includes a housing and a grip assembly. The housing includes a bore therethrough, and the downhole conveyance extends linearly through the bore from a first opening in the housing to a second opening in the housing. The grip assembly is at least partially positioned in the bore to receive and engagingly hold the downhole conveyance in the downhole tool at a tension.

At 504, a force is exerted on the downhole conveyance. The force is related to the tension in the downhole conveyance. The force may have been received at the very beginning of the operation. Discussing the force in this step does not indicate its occurrence in timing or order. The force can be a dynamic tensile load related to the mass of the downhole tool string and its acceleration/deceleration. In some examples, the force is at least equal to a breaking force of the downhole conveyance.

At 506, the force on the downhole conveyance is resisted with the grip assembly by the tension. The grip assembly includes a sleeve and a tubular member. The sleeve encloses the portion of the downhole conveyance and engaged with the tubular member positioned in the housing. An interface between the sleeve and the tubular member includes an increased friction surface relative to an interface between the downhole conveyance and the tubular member. In some examples, the sleeve includes a stainless steel mesh.

In some implementations, the housing includes a first half shell and a second half shell. The first and second half shells enclose the tubular member and are coupled together with one or more fasteners. The one or more fasteners bias the tubular member radially against the sleeve.

In some implementations, the grip assembly includes a wedge enclosed in a portion of the bore. The wedge includes an outer radial surface interfaced with a tapered portion of the bore and an inner radial surface at the tension. The wedge is threadingly coupled at the outer radial surface with the tapered portion of the bore. The downhole conveyance is held with the wedge to resist the force.

In some implementations, the wedge is biased with a biasing member positioned in the bore adjacent the wedge and driven toward a smaller opening of the tapered portion of the bore to hold the wire with the wedge. In some examples, the biasing member includes at least one spring. In some examples, the wedge is hydraulically driven toward the smaller opening of the tapered portion of the bore to hold the wire with the wedge. In such cases, an interior cavity of the housing is exposed to a hydrostatic pressure in the wellbore, and a piston mounted in the interior cavity against the wedge based on a difference in the hydrostatic pressure and a pressure in the bore of the housing.

A number of examples have been described. Nevertheless, it will be understood that various modifications may be made. For example, even though the illustrations in FIGS. 3A and 3B use respective piston and spring configurations with a wedge as the grip assembly, other configurations are possible, such as a threaded connection, a clamp, or any combination thereof. Accordingly, other examples are within the scope of the following claims.

What is claimed is:

1. A downhole tool, comprising:

a housing that comprises a bore therethrough to receive a portion of a downhole conveyance that extends linearly through the bore from a first opening in the housing to a second opening in the housing, the downhole conveyance comprising a communication line sized to communicate instructions that comprises at least one of logic or data; and a grip assembly at least partially positioned in the bore to engagingly hold the portion of the downhole conveyance at a tension at least equal to a breaking strength of the downhole conveyance the grip assembly comprising a wedge enclosed in a portion of the bore, the wedge including a tapered outer radial surface interfaced with a tapered portion of the bore and an inner radial surface that engagingly holds the portion of the downhole conveyance at the tension, and further wherein the tapered outer radial surface tapers radially outward as the grip assembly extends downhole.

2. The downhole tool of claim 1, wherein the communication line comprises at least one of a fiber optic line or a metallic conductor.

3. The downhole tool of claim 1, wherein the downhole conveyance comprises a non-metallic composite material.

4. The downhole tool of claim 1, wherein the grip assembly comprises:

a sleeve that encloses the portion of the downhole conveyance; and a tubular member positioned in the housing to receive and engagingly hold the portion of the downhole conveyance enclosed by the sleeve, an interface between the sleeve and the tubular member comprising an increased friction surface relative to an interface between the downhole conveyance and the tubular member.

5. The downhole tool of claim 4, wherein the sleeve comprises a stainless steel mesh.

6. The downhole tool of claim 4, wherein the housing comprises a first half shell and a second half shell, the first and second half shells enclosing the tubular member and coupled together with one or more fasteners to bias the tubular member radially against the sleeve.

7. The downhole tool of claim 1, wherein the grip assembly further comprises a threaded connection between the outer radial surface of the wedge and the tapered portion of the bore.

8. The downhole tool of claim 1, wherein the grip assembly further comprises a biasing member, positioned in the bore adjacent the wedge, that exerts a biasing force to drive the wedge toward a smaller opening of the tapered portion of the bore.

9. The downhole tool of claim 8, wherein the biasing member comprises at least one spring.

10. The downhole tool of claim 8, wherein the housing further comprises at least one port fluidly coupled to an annulus of a wellbore when the downhole tool is in a run-in position in the wellbore such that at least a portion of the bore is at a hydrostatic pressure of the annulus, the biasing member comprising a piston, in contact with the wedge, that drives the wedge toward the smaller opening based on the hydrostatic pressure.

11. The downhole tool of claim 1, further comprising a bottom hole connection assembly coupled with the housing and comprising a bore therethrough that receives the downhole conveyance and is coupled to the bore of the housing.

12. The downhole tool as recited in claim 1, wherein the downhole conveyance is a non-braided wireline or slickline conveyance.

13. A method, comprising:

running a downhole tool coupled to a downhole conveyance into a wellbore from a terranean surface, the downhole tool comprising:

a housing that comprises a bore therethrough, the downhole conveyance extending linearly through the bore from a first opening in the housing to a second opening in the housing, the downhole conveyance comprising a communication line sized to communicate instructions that comprise at least one of logic or data; and a grip assembly at least partially positioned in the bore to receive and engagingly hold the downhole conveyance in the downhole tool at a tension, the grip assembly comprising a wedge enclosed in a portion of the bore, the wedge including a tapered outer radial surface interfaced with a tapered portion of the bore and an inner radial surface that engagingly holds the portion of the downhole conveyance at the tension, and further wherein the tapered outer radial surface tapers radially outward as the grip assembly extends downhole;

exerting a force on the downhole conveyance in an uphole direction; and resisting the force on the downhole conveyance with the grip assembly.

14. The method of claim 13, wherein the communication line comprises at least one of a fiber optic line or a metallic conductor.

15. The method of claim 13, wherein the downhole conveyance comprises a non-metallic composite material.

16. The method of claim 13, wherein resisting the force on the downhole conveyance with the grip assembly comprises:

engaging a sleeve that encloses the portion of the downhole conveyance with a tubular member positioned in the housing, an interface between the sleeve and the tubular member comprising an increased friction surface relative to an interface between the downhole conveyance and the tubular member; and holding the downhole conveyance, based on the interface of the sleeve and the tubular member, to withstand the force exerted on the conveyance.

17. The method of claim 16, wherein the sleeve comprises a stainless steel mesh.

18. The method of claim 16, wherein the housing comprises a first half shell and a second half shell, the first and second half shells enclosing the tubular member and coupled together with one or more fasteners, the method comprising:

biasing the tubular member radially against the sleeve by the one or more fasteners.

19. The method of claim 13, wherein the wedge is threadingly coupled at the outer radial surface with the tapered portion of the bore.

20. The method of 13, further comprising:

biasing the wedge with a biasing member positioned in the bore adjacent the wedge; and driving the wedge toward a smaller opening of the tapered portion of the bore to hold the downhole conveyance with the wedge.

21. The method of claim 20, wherein the biasing member comprises at least one spring.

22. The method of claim 20, further comprising:

hydraulically driving the wedge toward a smaller opening of the tapered portion of the bore to hold the downhole conveyance with the wedge.

23. The method of claim 22, wherein hydraulically driving the wedge toward a smaller opening of the tapered portion of the bore comprises:

exposing an interior cavity of the housing to a hydrostatic pressure in the wellbore; and driving a piston mounted in the interior cavity against the wedge based on a difference in the hydrostatic pressure and a pressure in the bore of the housing.

24. The method as recited in claim 13, wherein the downhole conveyance is a non-braided wireline or slickline conveyance.

25. A downhole system, comprising:

a wireline conveyance extendable from a terranean surface to a position in a wellbore adjacent a subterranean zone, the wireline conveyance sized to communicate instructions that comprise at least one of logic or data;

a connector coupled to a portion of the wireline conveyance, the connector comprising:

a gripping member that defines a passage for receiving the portion of the wireline conveyance, the portion of the wireline conveyance extending linearly through the passage, the gripping member engagingly holding the portion of the wireline conveyance at a tension at least equal to a breaking strength of the wireline conveyance, the gripping member comprising a wedge enclosed in a portion of the bore, the wedge including a tapered outer radial surface interfaced with a tapered portion of the bore and an inner radial surface that engagingly holds the portion of the downhole conveyance at the tension, and further wherein the tapered outer radial surface tapers radially outward as the gripping member extends downhole; and a housing member that comprises a bore that encloses the gripping member; and a downhole tool string coupled to the wireline conveyance through the connector to receive or communicate the instructions between the downhole tool string and the terranean surface.

26. The downhole system of claim 25, wherein the gripping member comprises:

a sleeve that encloses the portion of the wireline conveyance; and a tubular member that receives and engagingly holds the portion of the wireline conveyance enclosed by the sleeve, an interface between the sleeve and the tubular member comprising an increased friction surface relative to an interface between the wireline conveyance and the tubular member.

27. The downhole system of claim 26, wherein the housing member comprises a body and a cover, the body and the cover enclosing the tubular member and coupled together with one or more fasteners to bias the tubular member radially against the sleeve, the body comprising one or more resisting members to keep the gripping member and the cover axially in position.

28. The downhole system of claim 25, wherein the gripping member further includes a biasing member, positioned in the bore adjacent the wedge, that exerts a biasing force to drive the wedge toward a smaller opening of the tapered portion of the bore.

29. The downhole system of claim 28, wherein the biasing member comprises at least one spring.

30. The downhole system of claim 25, wherein the housing member further comprises at least one port fluidly coupled to an annulus of the wellbore when the connector is in a run-in position in the wellbore such that at least a portion of the bore is at a hydrostatic pressure of the annulus, the biasing member comprising a piston, in contact with the wedge, that drives the wedge toward the smaller opening based on the hydrostatic pressure.

* * * * *